US009227440B2

(12) United States Patent
Yanagishita

(10) Patent No.: US 9,227,440 B2
(45) Date of Patent: Jan. 5, 2016

(54) INK JET TEXTILE PRINTING APPARATUS

(71) Applicant: SEIKO EPSON CORPORATION, Tokyo (JP)

(72) Inventor: Kenji Yanagishita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/721,489

(22) Filed: May 26, 2015

(65) Prior Publication Data

US 2015/0251463 A1 Sep. 10, 2015

Related U.S. Application Data

(63) Continuation of application No. 14/341,498, filed on Jul. 25, 2014, now Pat. No. 9,067,434, which is a continuation of application No. 13/595,983, filed on Aug. 27, 2012, now Pat. No. 8,820,874.

(30) Foreign Application Priority Data

Aug. 29, 2011 (JP) ..... 2011-185606

(51) Int. Cl.

| | |
|---|---|
| ***B41J 29/38*** | (2006.01) |
| ***B41J 13/00*** | (2006.01) |
| ***B41J 2/01*** | (2006.01) |
| ***B41J 3/407*** | (2006.01) |

(52) U.S. Cl.

CPC ..... *B41J 13/0009* (2013.01); *B41J 2/01* (2013.01); *B41J 3/4078* (2013.01)

(58) Field of Classification Search

CPC ..... B41J 2/17566; B41J 2/195; B41J 2/211; B41J 2/214; B41J 2/2117; B41J 2/4078

See application file for complete search history.

(56) References Cited

U.S. PATENT DOCUMENTS

| | | | | |
|---|---|---|---|---|
| 7,874,629 | B2 | 1/2011 | Mizutani | |
| 8,820,874 | B2 * | 9/2014 | Yanagishita | 347/16 |
| 2004/0179081 | A1 | 9/2004 | Nimi et al. | |
| 2005/0151773 | A1 | 7/2005 | Watarai | |
| 2006/0015268 | A1 | 1/2006 | Paik et al. | |
| 2006/0203069 | A1 | 9/2006 | Niimi et al. | |
| 2007/0188578 | A1 | 8/2007 | Kayanaka | |
| 2009/0056582 | A1 | 3/2009 | Mizutani | |
| 2011/0037802 | A1 | 2/2011 | Brewington et al. | |

FOREIGN PATENT DOCUMENTS

| | | |
|---|---|---|
| JP | 2004-291399 | 10/2004 |
| JP | 2005-045644 | 2/2005 |
| JP | 2005-199507 | 7/2005 |
| JP | 2006-240082 | 9/2006 |
| JP | 2007-216502 | 8/2007 |
| JP | 2009-051114 | 3/2009 |
| JP | 2011-037269 | 2/2011 |

* cited by examiner

*Primary Examiner* — Juanita D Jackson
(74) *Attorney, Agent, or Firm* — Workman Nydegger

(57) ABSTRACT

A tray mounting unit in which it is possible to replace a plurality of types of set trays; a detector capable of detecting the type of set tray mounted on the tray mounting unit in a state where the target textile printing material is set; a determining unit determining whether the type of set tray detected by the detector and the type of set tray recognized in advance are matched or mismatched; and a control unit performing a predetermined operation based on the determining result of the determining unit, are provided. Thus, inconsistencies in the type of set tray may be detected thereby preventing textile printing defects caused by such inconsistencies.

7 Claims, 13 Drawing Sheets

INK JET TEXTILE PRINTING APPARATUS

CROSS-REFERENCE TO RELATED APPLICATIONS

This application is a continuation of U.S. patent application Ser. No. 14/341,498, filed Jul. 25, 2014, now U.S. Pat. No. 9,067,434 and continuation application of U.S. patent application Ser. No. 13/595,983, filed Aug. 27, 2012, now U.S. Pat. No. 8,820,874 which patent applications are incorporated herein by reference in their entirety. U.S. patent application Ser. No. 13/595,983 claims the benefit of and priority to Japanese Patent Application No. 2011-185606 filed Aug. 29, 2011, the contents of which are hereby incorporated by reference in its entirety.

BACKGROUND OF THE INVENTION

1. The Field of the Invention

The present invention relates to an ink jet textile printing apparatus that performs textile ink jet printing on fabric, that is, on target textile printing material.

2. The Relevant Technology

Hitherto, ink jet textile printing apparatuses that eject various colors of ink from a textile printing head to thereby print a desired image on the surface of fabrics (such as T-shirts) have been developed and come into widespread use. In such ink jet textile printing apparatuses, a set tray positions the fabric (such as a T-shirt or the like) and regulates the interval between the fabric and the surface of the textile printing head nozzle opening to be a predetermined distance.

The set trays are structured so that it is possible to replace and use a plurality of types of set trays having different shapes and sizes and the like according to 1) differences in the shape and size of the fabric to be printed; 2) differences in the size of the image to be printed or the direction to be printed; or 3) differences in the form of printing (such as cases in which multiple pieces of fabric are to be simultaneously printed on and cases in which only one piece of fabric is to be printed on. Thus, according to the respective printing objectives, the plurality of types of set trays are appropriately replaced with set trays matching the objectives of the printing and used by the user.

If the set tray actually set by the user was different than the set tray recognized by the ink jet textile printing apparatus, an image is sometimes printed at a position and in a direction different to that which the user was expecting, or ink ejected from the textile printing head sometimes comes out of the set tray and stains the environment around the set tray.

As one technology that improves textile printing defects based on such erroneous recognition of the set tray occurring at the time of replacing the set tray or the like, the technique shown in the following Patent Literature 1 has been provided. In this technique, comparison is made between the stored information of the type of the previous set tray and the designated information of the type of the current set tray. When the previous and current set trays types are different, notification is provided to the user, and the generation of the textile printing defects is often prevented in advance.

CITATION LIST

Patent Literature

[PTL 1] JP-A-2009-51114

BRIEF SUMMARY OF THE INVENTION

However, in Patent Literature 1 above, the judgement of the differences of the types of set trays is based only on the input information from the user. Accordingly, in a case where the input information of the user is wrong, or in a case where a set tray is mounted in error, accurate judgement of the type of set tray is not possible and the previously mentioned textile printing defects are generated.

Accordingly, an object of the present invention is to grasp mismatches in the type of set tray and proactively prevent textile printing defects of target textile printing materials in cases where the type of set tray actually being set is different from the type of set tray recognized by an ink jet textile printing apparatus.

Solution to Problem

A first aspect of the ink jet textile printing apparatus according to the present invention for solving the above problems includes: a tray mounting unit in which it is possible to replace a plurality of types of set trays; a detector capable of detecting the type of set tray mounted on the tray mounting unit in a state where the target textile printing material is positioned; a determining unit determining whether the type of set tray detected by the detector and the type of set tray recognized in advance are matched or mismatched; and a control unit performing a predetermined operation based on the determining result of the determining unit.

Here, the "predetermined operation" may mean to start textile printing without change in a case where the determining result is "matched" and to perform an operation set beforehand in order to prevent in advance the generation of defects caused by performing textile printing in such a state in a case where the determining result is "mismatched".

Here, "target textile printing material" signifies the "cloth" which is the target of the textile printing, and includes natural fibers such as cotton, silk, and wool, synthetic fibers such as nylon, or woven material, knitted material, nonwoven fabric, and the like of composite fibers in which the above are mixed, as well as including both long ones wound into a roll shape and ones cut to a predetermined length. In addition, as well as clothing such as sewn T-shirts, types of furniture such as sewn handkerchiefs, scarves, towels, curtains, sheets, and bed covers, there is also included cut and uncut cloth and the like present as parts in a pre-sewing state.

According to this aspect, by providing a detector capable of detecting the type of set tray mounted on the tray mounting unit in a state where the target textile printing material is positioned in the set tray, it is possible to detect and specify the type of set tray provided in actual use in a state in which the target textile printing material is positioned. Therefore, in a case where the type of the detected set tray and the type of the set tray recognized in advance are compared and both are matched, it is possible to move to the textile printing start process as is, and the usability is improved. Further, in a case where both are mismatched, it is possible to prevent the generation of defective products in the textile printing in advance.

A second aspect of the ink jet textile printing apparatus according to the present invention is based on the first aspect and further includes: a textile printing head ejecting ink to the target textile printing material and forming a printed image; and a moving unit which moves the set tray between a set position positioning the target textile printing material and a textile printing start position of the target textile printing material present across the region where textile printing is performed by the textile printing head, in which, the detection of the type of set tray by the detector is performed when moving the set tray from the set position to the textile printing start position. Here, the "textile printing start position" signifies a position at which the set tray starts to move in order to print onto the target textile printing material.

According to the present aspect, in addition to the action and effect of the first aspect, by providing a moving unit which moves the set tray between a set position setting the target textile printing material and a textile printing start position of the target textile printing material present across the region where textile printing is performed by the textile printing head, in addition to the performing of the textile printing of the target textile printing material, the detection of the type of the set tray by the detector is set to be performed at the same time during the movement which becomes necessary from the setting position of the set tray to the textile printing start position.

Accordingly, it is possible to efficiently detect the type of set tray using the necessary movement step of the set tray without increasing the time necessary for the textile printing of the target textile printing material. Thus, it is possible to determine whether the set tray is mismatched.

A third aspect of the ink jet textile printing apparatus according to the present invention is based on the second aspect, in which, when the determining result of the determining unit is of a mismatch, the control unit performs control returning the set tray to the set position as one predetermined operation without performing textile printing.

According to the present aspect, when the determining result of the determining unit is "mismatch", since the set tray is returned to the set position without textile printing being performed, it is possible to quickly set about starting the replacement of the set tray which becomes necessary when a mismatch of the types of the set trays is determined. Thus, it is possible to quickly move to textile printing of the target textile printing material using the correct set tray.

A fourth aspect of the ink jet textile printing apparatus according to the present invention is based on the second aspect and the third aspect, in which the set tray is provided with first target detection portions positioned at one side and the other side in the moving direction of the set tray outside the region taken up by the target textile printing material in the state where the target textile printing material is set, and the detection of the type of the set tray by the detector is performed based on the detection timing of the first target detection portions when the set tray is moved from the set position to the textile printing start position.

Here, the "detection timing" signifies the timing at which the presence or absence of the first detection portion is detected. However, this detection timing is not limited to a case in which the type of set tray is detected by a single detection, and may be extended to a case in which the type of the set tray is detected by performing detection of the first detection portions multiple times (such as twice or more).

According to the present aspect, first target detection portions are provided. The portions are positioned at one side and the other side in the moving direction of the set tray outside the region taken up by the target textile printing material in the state where the target textile printing material is set on the set tray The detection of the type of the set tray by the detector is performed based on the detection timing of the first target detection portions when the set tray is moved from the set position to the textile printing start position. Accordingly, it is possible to perform the position detection of the moving direction of the set tray using the detection timing of the first detection portions. In this manner, simply by moving the set tray in the moving direction, it is possible to accurately specify differences in the configuration such as the size, shape, or the like of the set tray.

A fifth aspect of the ink jet textile printing apparatus according to the present invention is based on the fourth aspect, in which second target detection portions are provided so as to be positioned at least one side in the direction intersecting the moving direction of the set tray outside the region taken up by the target textile printing material in the state where the target textile printing material is set in the set trayThe detection of the type of the set tray by the detector is performed based on the detection timing of the first target detection portions when the set tray is moved from the set position to the textile printing start position and on the detection information obtained by moving the detector in the direction passing through the second target detection portions.

According to this aspect, using the detection information of the second detection portions, it is possible to perform position detection of the left-right width direction when the moving direction of the set tray is set to the front-back direction. In this manner, it is possible to detect differences in types in which the lengths of the moving direction of the set trays are the same and the lengths in the width direction are different.

Accordingly, based on the detection timing information with respect to the first detection portions and the detection information with respect to the second detection portions, it is possible to accurately specify differences in the sizes, shapes, and the like of the set trays in an ink jet textile printing apparatus having a structure in which a greater number of types of set tray can be replaced than in the fourth aspect.

DETAILED DESCRIPTION OF THE PREFERRED EMBODIMENTS

Figure 1:
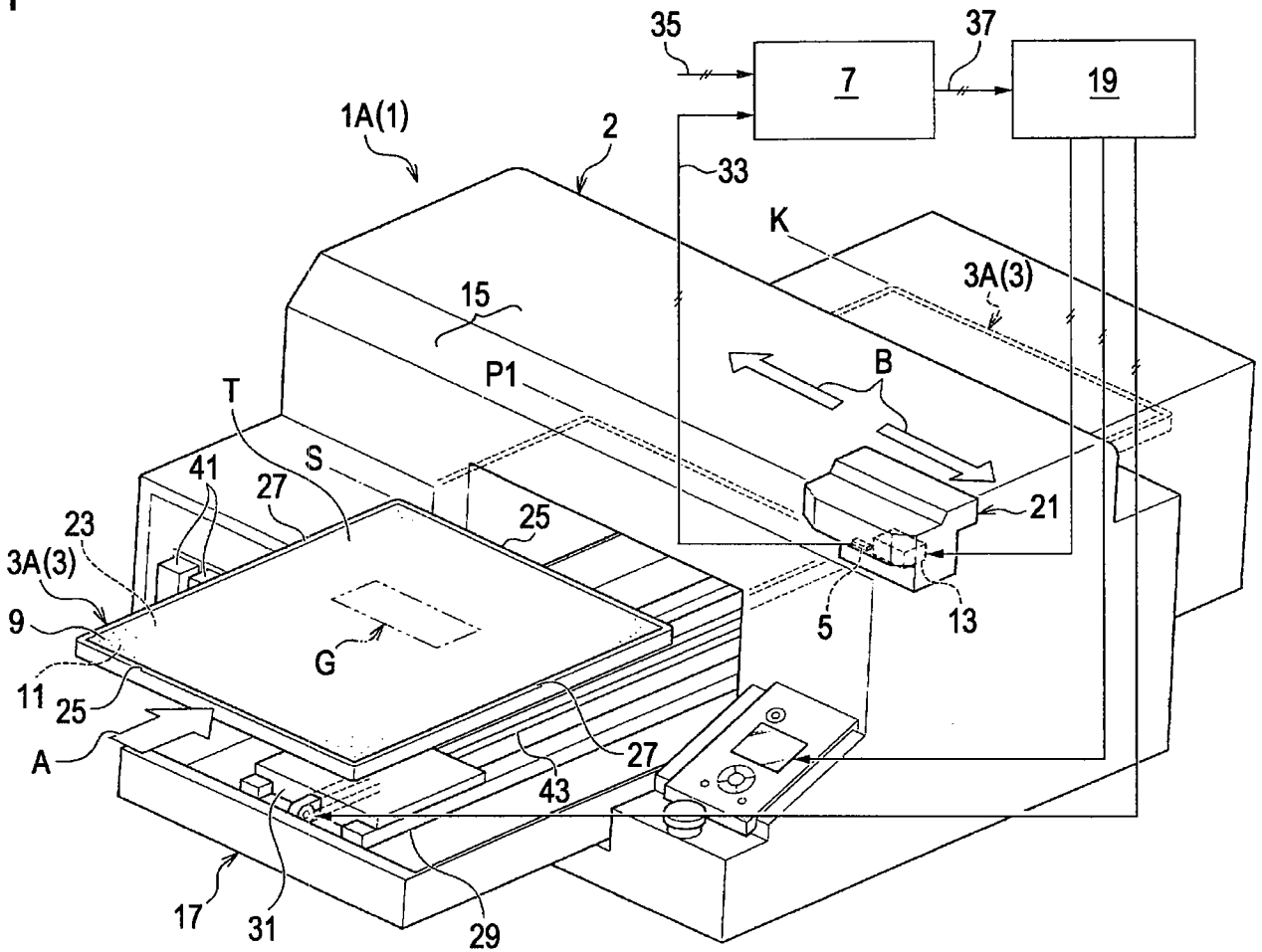
FIG. 1 is a perspective view showing a schematic configuration of an ink jet textile printing apparatus according to Example 1 of the present invention.
Figure 2:
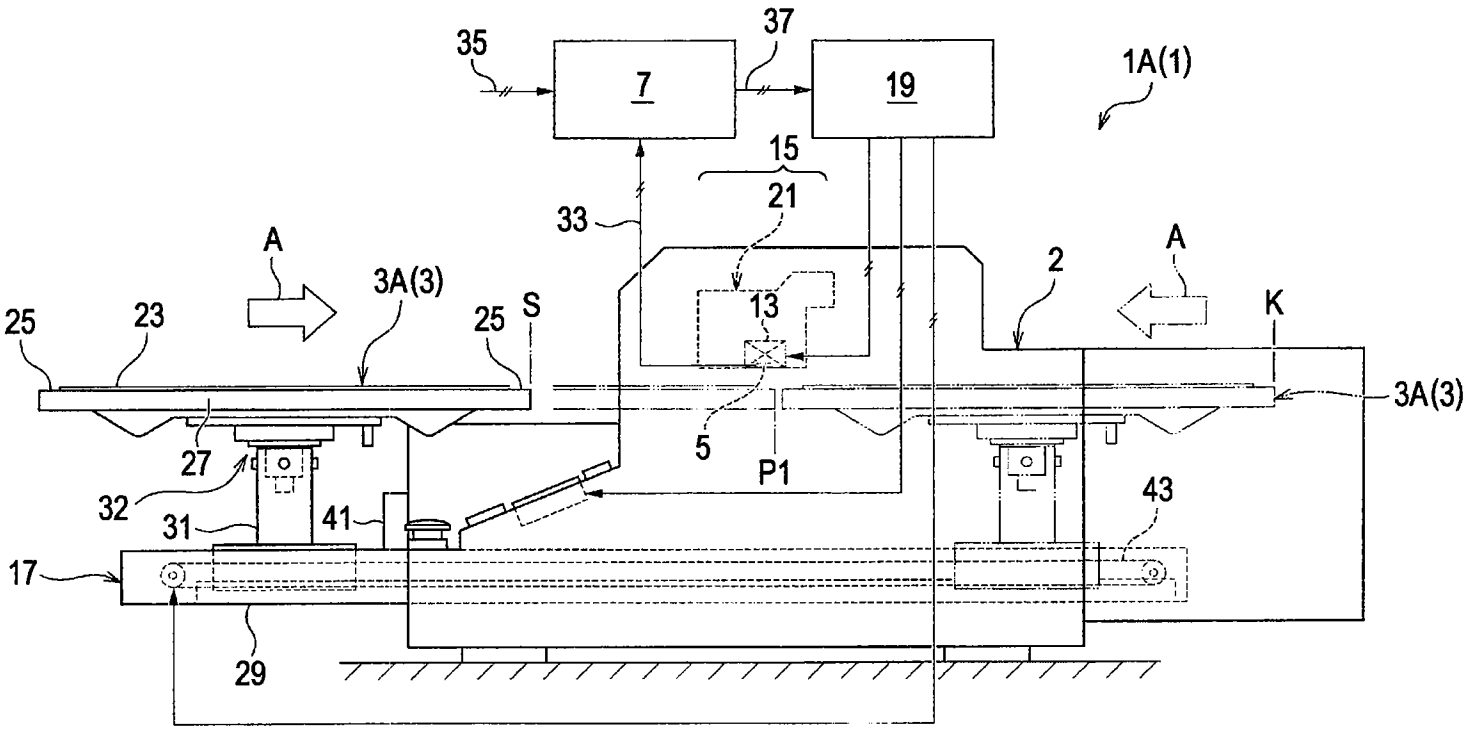
FIG. 2 is a side cross-sectional view showing a schematic configuration of the ink jet textile printing apparatus according to Example 1 of the present invention.
Figure 3:
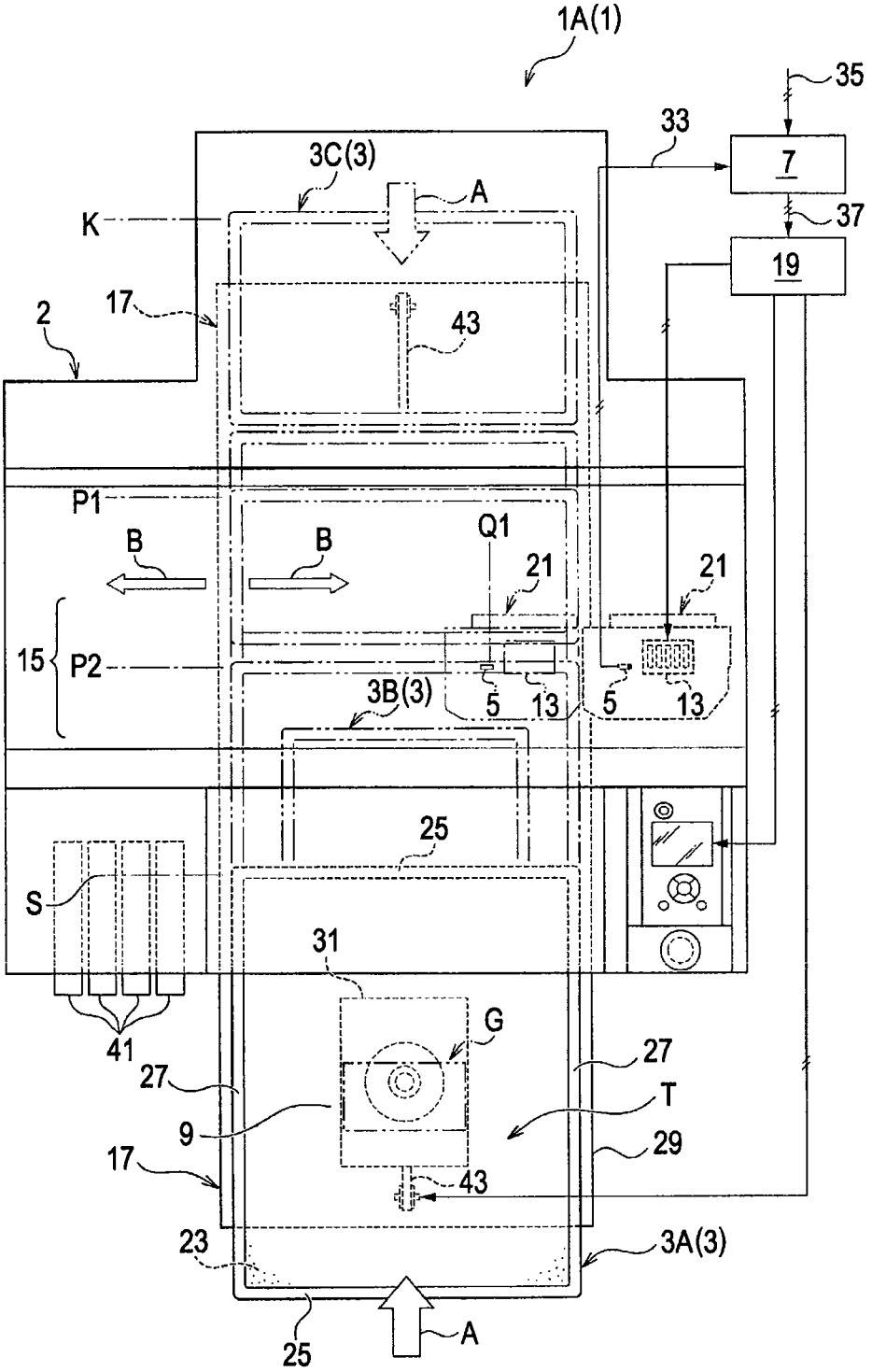
FIG. 3 is a plan view showing a schematic configuration of the ink jet textile printing apparatus according to Example 1 of the present invention.

Below, taking Example 1 shown in FIGS. 1 to 7 and Example 2 shown in FIGS. 8 to 13 as examples, the configuration of an ink jet textile printing apparatus 1 of the present invention and an ink jet textile printing method performed using the ink jet textile printing apparatus 1 will be described in sequence.

In addition, in the following description, as a target textile printing material (below referred to as "fabric") T, a T-shirt in which the body part and the sleeve parts are sewn in a cylindrical shape is taken as an example, and, in the description, the surface of the front side on which a printed image G is formed on the T-shirt is a first surface 9 and the surface of the rear side of the opposite side to the first surface 9 is a second surface 11.

Example 1

Refer to FIGS. 1 to 7

The ink jet textile printing apparatus 1A(1) of the present Example 1 is provided with a tray mounting unit 32 in which it is possible to replace a plurality of types of set trays 3; a detector 5 capable of detecting the type of set tray 3 mounted on the tray mounting unit 32 in a state where the target textile printing material T is set; a determining unit 7 determining whether the type of set tray 3 detected by the detector 5 and the type of set tray 3' recognized in advance are matched or mismatched; and a control unit 19 performing a predetermined operation based on the determining result of the determining unit 7.

In addition, the ink jet textile printing apparatus 1A of Example 1 includes: a textile printing head 13 ejecting ink to the target textile printing material T and forming a printed image G; and a moving unit 17 which moves the set tray 3 between a set position S setting the target textile printing material T and a textile printing start position K of the target textile printing material T present across the region 15 where textile printing is performed by the textile printing head 13. Here, the detection of the type of set tray 3 by the detector 5 is performed when moving the set tray 3 from the set position S to the textile printing start position K.

In addition, specifically, although some parts are repeated, there is provided: a textile printing head 13 ejecting ink to the first surface 9 of the target textile printing material T and forming a desired printed image G; a set tray 3 setting the target textile printing material T and supporting the second surface 11 of the target textile printing material T; and a moving unit 17 reciprocally moving the set tray 3 between a set position S setting the target textile printing material T and a textile printing start position K of the target textile printing material T present across the textile printing performing region 15 where the textile printing head 13 is present.

Then, when the determining result of the determining unit 7 is a "mismatch", the control unit 19 is configured to perform control returning the set tray 3 to the set position S as one predetermined operation without performing textile printing. Further, in the present Example 1, when the determining unit 7 has determined that there is a "mismatch", the mismatch of the type of the set tray 3 is also notified to the user.

Further, in the ink jet textile printing apparatus 1A according to Example 1, the textile printing head 13 as shown in FIG. 1 is held in the apparatus main body 2 in a state of being moveable in the scan direction B which is the direction perpendicular to the moving direction A of the set tray 3. Specifically, the textile printing head 13 is mounted on a carriage 21 which is reciprocally moveable in the scan direction B inside the apparatus main body 2. Here, the detector 5 is provided on the carriage 21.

Here, in the present Example 1, a structure is adopted in which the set tray 3 is moved in the moving direction A and the detector 5 is fixed with respect to the moving direction A. However, Example 1 is not limited thereto. By fixing a position without moving the set tray 3 in the moving direction A, and moving the apparatus main body 2 side holding the detector 5 (that is, the carriage 21 in the direction A), a state corresponding to the set position S and a state corresponding to the textile printing start position K may be realized.

In short, the relationship with respect to the direction A of the set tray 3 and the detector 5 should be a relationship of relative movement. Therefore, moving both the set tray 3 and the detector 5, it is also possible to realize a state corresponding to the set position S and a state corresponding to the textile printing start position K.

Furthermore, in the present Example 1, the set tray 3 is provided with first target detection portions 25 and 25 positioned at a front side and a rear side in the moving direction A of the set tray 3 outside the region taken up by the target textile printing material T in the state where the target textile printing material T is set. In other words, the first target detection portions 25 and 25 are positioned at a front side and a rear side in the moving direction A of the set tray 3 outside the peripheral portion of the region taken up by the target textile printing material T in a state of exposure to the textile printing head 13 side in the state where the target textile printing material T is set in the set tray 3. Here, the detection of the type of set tray 3 by the detector 5 is performed based on detection timing of the first target detection portions 25 and 25 when moving the set tray 3 from the set position S to the textile printing start position K.

Below, specific description will be given of the various members described above configuring the ink jet textile printing apparatus 1A according to Example 1.

As an example, the textile printing head 13 is a textile printing performing member performing textile printing by directly ejecting ink supplied through a tube or the like to the first surface 9 of the target textile printing material T from the ink cartridge 41 positioned at the left side facing the apparatus main body 2. Here, in the present Example 1, the ink is ejected while the carriage 21 reciprocates in the scan direction B and a so-called serial-type textile printing head 13 is adopted as an example.

As an example, the set tray 3 is a rectangular flat member upon which a flat setting surface 23 for setting the target textile printing material T is formed. The setting surface 23 is a part directly supporting the second surface 11 of the target textile printing material T and the entire surface thereof is formed to be a flat surface such that the target textile printing material T can be set after stretching out wrinkles therein.

In front and behind the outer periphery of the setting surface 23, the first target detection portions 25 and 25 are formed in a pair with a structure that is a part of a frame 28 extending in the left-right direction. In addition, at the left and right sides of the outer periphery of the setting surface 23, the second target detection portions 27 and 27 are similarly formed in a pair that is a part of the frame 28 extending in the front-back direction. The second target detection portions 27 and 27 are used for detecting the type of the set tray 3 in Example 2 to be described later.

That is, the first detection portions 25 and 25 and the second detection portions 27 and 27 are integrally configured by a rectangular frame 28. The frame 28 is fitted and mounted to the periphery in order to maintain the wrinkle-free state of the target textile printing material T, which is in a state of being set in the set tray 3, once stretching of the wrinkles has been performed. In the present invention, the frame 28 is used as a detection portion of the detector 5.

The first target detection portions 25 and 25 and the second target detection portions 27 and 27 are formed of a suitable material having high light reflectivity, for example, metal or the like. Among these, the first target detection portions 25 and 25 are used in the position detection of the length direction along the moving direction A of the set tray 3 and the second target detection portions 27 and 27 are used in the position detection of the width direction of the set tray 3.

In addition, as the type of set tray 3 in the present Example, it is possible to use set trays 3 of three types shown in FIG. 5(A) to (C) as an example, and, among these, the set tray 3A shown in FIG. 5(A) is a large size set tray 3 suitable when the target textile printing material T is large or the printed image G has a wide range.

In addition, the set tray 3B shown in FIG. 5(B) is a small size set tray 3 suitable when the target textile printing material T is small or the printed image G only requires a narrow range. In addition, the set tray 3C shown in FIG. 5(C) has the same width dimension as the set tray 3A shown in FIG. 5(A) and a length dimension which is that of two set trays 3 of a size approximately half of the set tray 3A shown in FIG. 5(A) arranged in combination in the front-back direction. The set tray 3C is a set tray 3 having a suitable shape difference when performing textile printing after simultaneously setting two target textile printing materials T of a small size or target textile printing materials T with a small printed image G.

As an example, the moving unit 17 is configured by being provided with a support base 29 extending from the front side of the apparatus main body 2 of the ink jet textile printing apparatus 1A to the depths thereof along the moving direction A; a support platform 31 in the central portion of the left-right direction as an example of the upper part of the support base 29 having a slider provided to be capable of reciprocal movement along the moving direction A and a support column of a predetermined height; and a driving mechanism using, as an example, a timing belt 43 driving the support platform 31.

In addition, on the upper surface of the support platform 31, the previously described set tray 3 is mounted on the tray mounting unit 32 in an attachable and removable state with center standard alignment as an example. Here, the set tray 3 is configured so as to be moved along the moving direction A integrally with the set target textile printing material T and the support platform 31 and to be able to reciprocate between the previously described set position S and the textile printing start position K.

Figure 4:
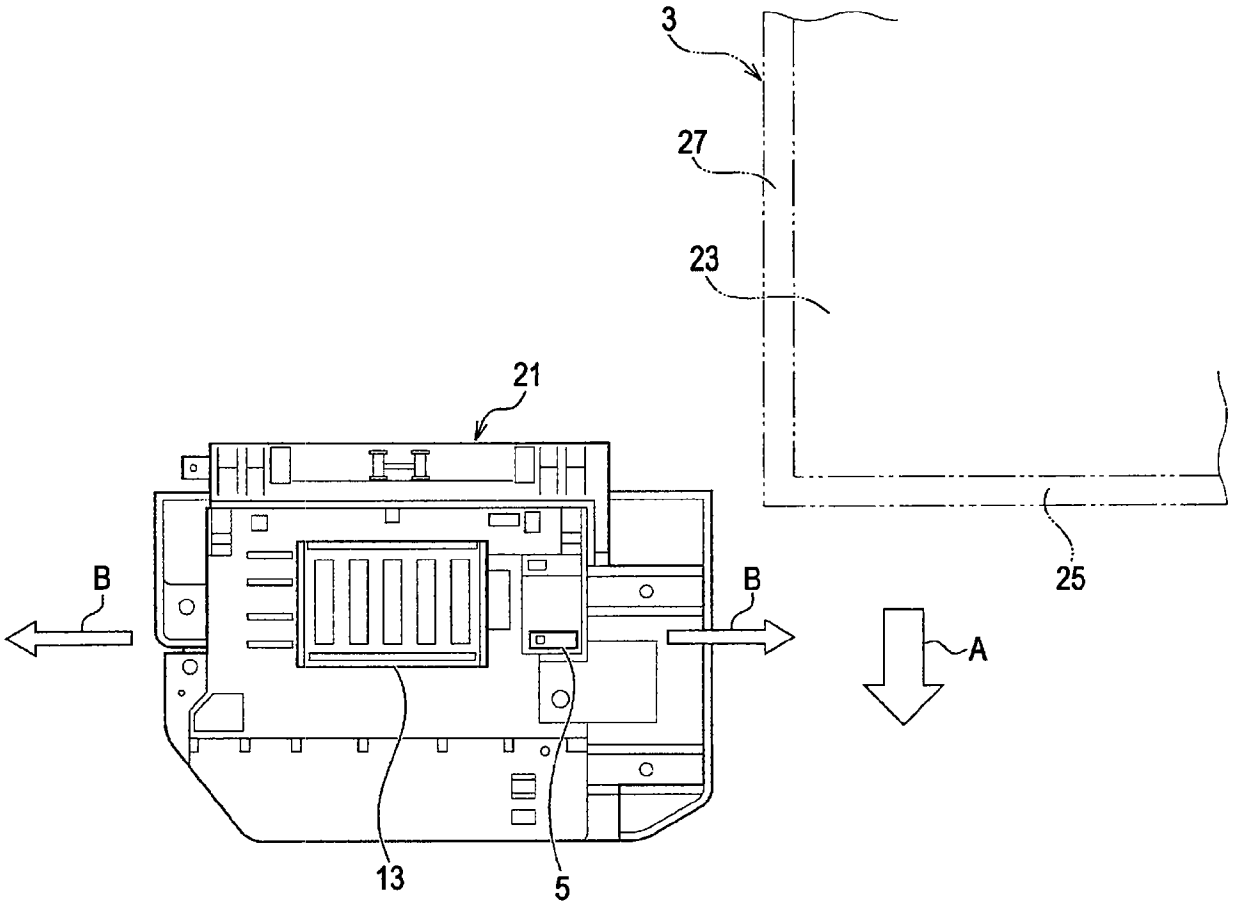
FIG. 4 is a bottom view of the carriage showing installation positions of the textile printing head and the detector of the ink jet textile printing apparatus according to Example 1 of the present invention.

As the detector 5, a reflection type optical sensor can be applied as an example, and may be installed on the bottom surface of the carriage 21 in the vicinity of the textile printing head 13 as shown in FIG. 4 as an example.

In addition, a configuration is adopted such that the light irradiated toward the lower part from the detector 5 hits the previously described first target detection portion 25 and the second target detection portion 27 and is reflected, and, by detecting the light returning back to the detector 5 again, it is possible to perform the position detection of the length direction and the width direction of the set tray 3 and specify the type of the set tray 3.

Based on the type information 33 of the set tray 3 sent from the detector 5 and the set information 35 set by the user, the determining unit 7 is a part which makes a comparison with the type of the set tray 3' recognized in advance by the ink jet textile printing apparatus 1A and determines whether both are matched or mismatched.

Here, in a case where matching of the set tray 3 is confirmed by the determining unit 7, textile printing is performed with respect to the target textile printing material T using the set tray 3. In a case where mismatching of the set tray 3 is confirmed by the determining unit 7, mismatch specifying information 37 is sent to the control unit 19.

The control unit 19 performs the processing when the mismatch specifying information 37 is sent from the determining unit 7. Specifically, when a mismatch of the type of set tray 3 is confirmed, the performance of the textile printing using the set tray 3 is stopped and a notification process is performed using audio or a display to inform the user of the mismatch of the type of set tray 3.

In addition, at the same time as the notification process, the set tray 3 present at the textile printing performing region 15 or the textile printing start position K is returned to the set position S and a discharging process prompting the replacement of the set tray 3 is performed.

Next, an ink jet textile printing method performed using the ink jet textile printing apparatus 1A according to Example 1 configured in this manner will be described focusing on the step of detecting and determining the type of set tray 3.

That is, the ink jet textile printing apparatus 1A is configured to be able to perform a set tray first movement step moving the set tray 3 in which the target textile printing material T is set to a first position P1 (FIG. 6(A)) which is a position capable of detecting a first detection portion 25 of the rear side (back side in the movement direction) using the detector 5; a set tray second movement step moving the set tray 3 moved to the first position P1 to a second position P2 (FIG. 6(B)(i)) which is a position capable of detecting a first detection portion 25 of the front side (near side in the movement direction) of the set tray 3C; a type specifying step specifying the type of the set tray 3 based on detection information detected in each movement step; and a determining step comparing the type of the set tray 3 specified in the type specifying step and the type of set tray 3' recognized in advance and determining whether both are matched or mismatched.

Figure 6:
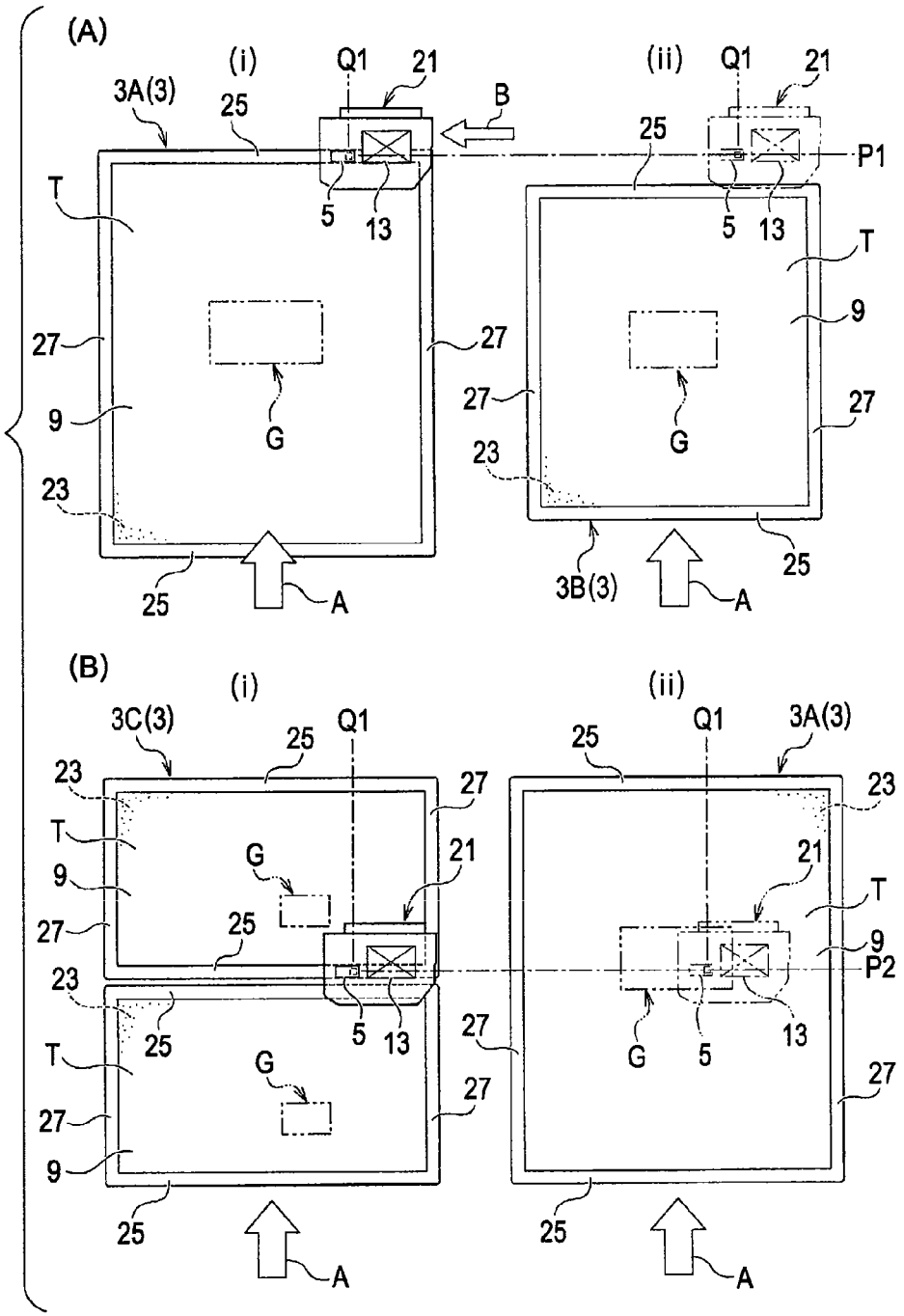
FIG. 6 is a plan view showing an example of the order of detecting the types of set tray using the ink jet textile printing apparatus according to Example 1 of the present invention.

Below, based on FIG. 6 and FIG. 7, detailed description will be given of an example of the detection process of the type of the set tray 3 and an example of the flow of operations at the time of detection.

After setting the target textile printing material T on the setting surface 23 of the set tray 3 positioned at the set position S, stretching the wrinkles, and fitting the frame 28 to the set tray 3, the user sets (set information 35) the type or the like of the set tray 3 to be used and issues a command to perform textile printing.

Figure 7:
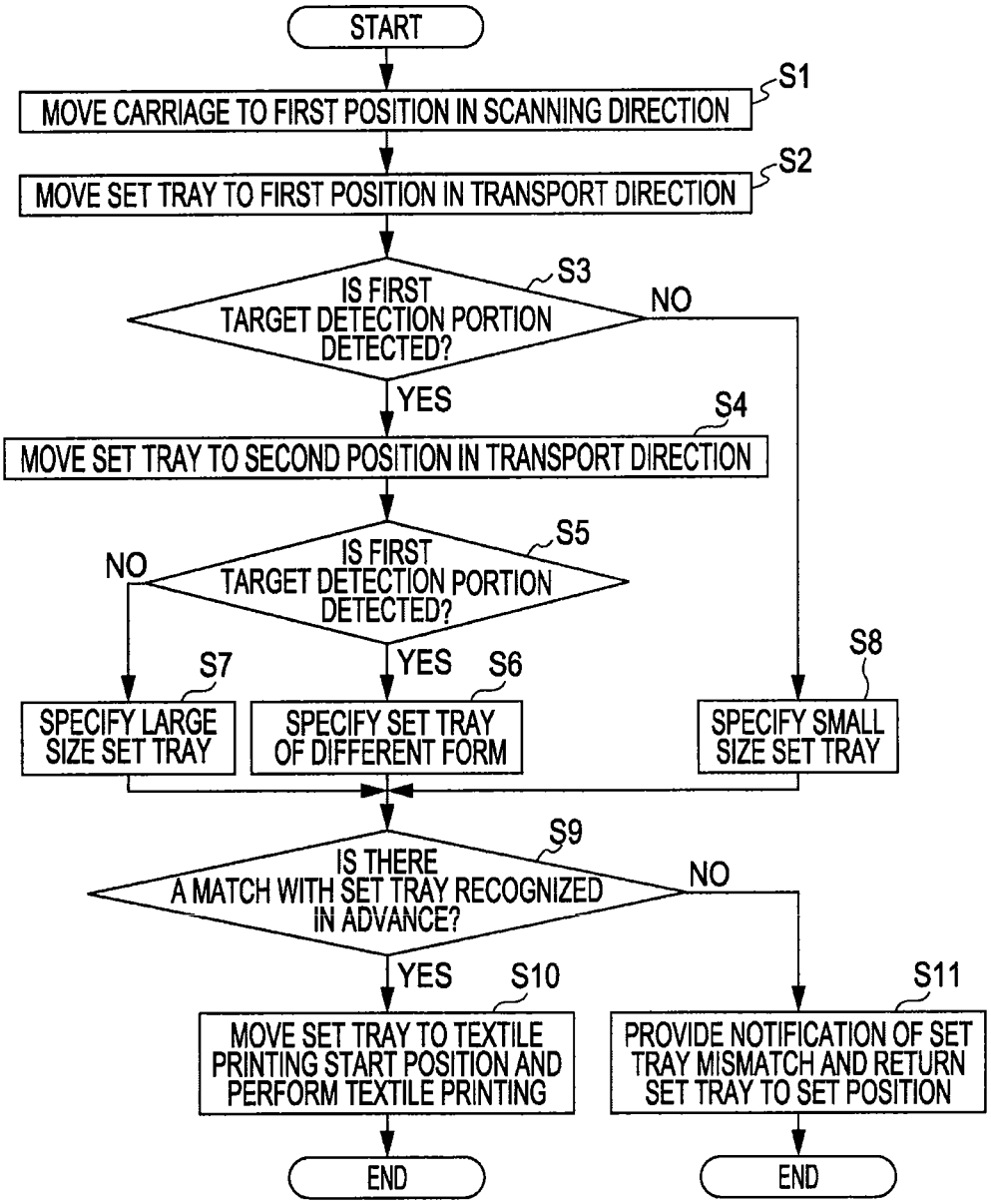
FIG. 7 is a flowchart showing an example of a flow of operations detecting the type of set tray using the ink jet textile printing apparatus according to Example 1 of the present invention.
Figure 8:
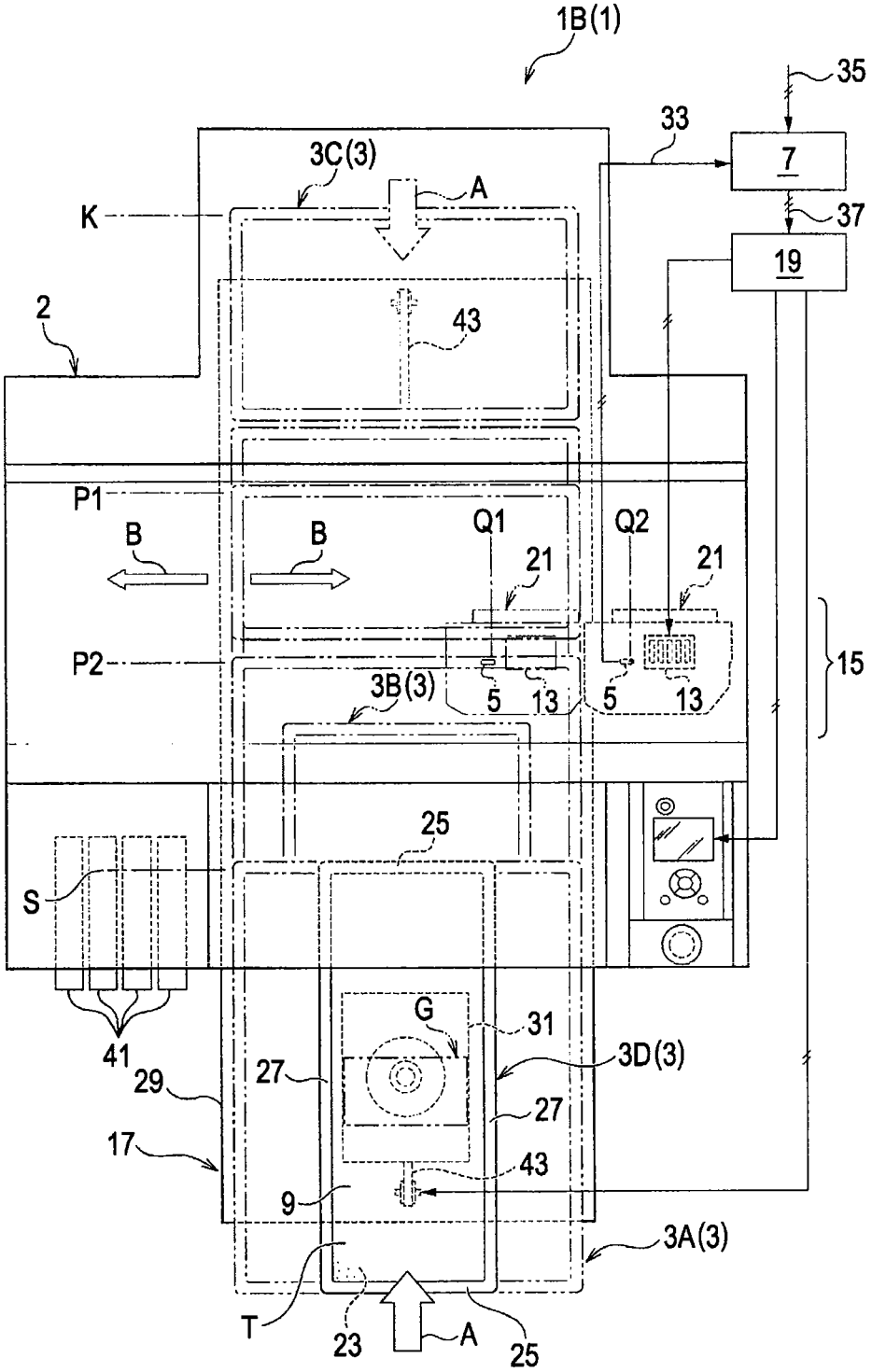
FIG. 8 is a plan view showing a schematic configuration of an ink jet textile printing apparatus according to Example 2 of the present invention.

Next, the command to perform the textile printing is received and the detection and determining operation of the set tray 3 in the flow shown in FIG. 7 is started, and, in step S1 in FIG. 7, the carriage 21 is made to move to the first position Q1 in the scanning direction.

Next, moving to step S2, the moving unit 17 is driven and the set tray 3 is made to move to the first position P1 in the moving direction. Here, at the first position P1 in the moving direction, at a time when a large size set tray 3A is used and a time when a differently shaped set tray 3C is used, a first target detection portion 25 at the rear side of these set trays 3A, and 3C is set to be positioned below the detector 5 as shown in FIG. 6(A)(i).

Meanwhile, when using a small size set tray 3B, as shown in FIG. 6(A)(ii), the first target detection portion 25 of the set tray 3B below the detector 5 is in a state of not yet being reached.

Next, returning to FIG. 7 and moving to step S3, the detector 5 positioned at the first position Q1 in the scanning direction performs determination of whether or not the first target detection portion 25 is detected. Then, in a case where detection of the first target detection portion 25 is confirmed, the process moves to step S4, the moving unit 17 is driven again, and the set tray 3 is made to move up to the second position P2 in the moving direction.

Here, at the second position P2 in the moving direction, at a time when a differently shaped set tray 3C is used, the first target detection portion 25 of the set tray 3C and an interval between the front and rear set trays 3C are confirmed by the detector 5 as shown in FIG. 6(B)(i). Meanwhile, when using a large size set tray 3A, these are not confirmed since the first target detection portion 25 and the interval as shown in FIG. 6(B)(ii) are not present.

Next, returning to FIG. 7, it is determined whether or not the first target detection portion 25 was detected in step S5, and, in a case where the first target detection portion 25 was detected, the process moves to step S6 and the differently shaped set tray 3C is specified.

Further, in a case where it is determined that the first target detection portion 25 was not detected in step S5, the process moves to step S7 and the large size set tray 3A is specified.

Further, in a case where it is determined that the first target detection portion 25 was not detected in step S3, the process moves to step S8 and the small size set tray 3B is specified.

Next, moving to step S9, in a case where determination of whether or not there is a match with the set tray 3' recognized in advance is performed and it is determined that there is a match with the set tray 3' recognized in advance, the process moves to step S10, the moving unit 17 is driven, the set tray 3 is made to move up to the textile printing start position K, and textile printing is performed.

Meanwhile, in a case where it is determined that there is no match with the set tray 3' recognized in advance in step S9, the process moves to step S11, notification of the mismatch of the set tray 3 is provided, the moving unit 17 is driven in the reverse direction, and the set tray 3 is returned to the starting set position S.

When using the ink jet textile printing apparatus 1A according to the present Example 1, since detection and determination of the type of the set tray 3 are performed in the stage of moving from the set position S of the set tray 3 to the textile printing start position K, the detection and determination of the type of set tray 3 are performed efficiently without taking time especially for detection and determination of the type of set tray 3. In this manner, it is possible to prevent in advance the occurrence of textile printing defects caused by the mismatch of the set tray 3.

Example 2

Refer to FIGS. 8 to 11

The ink jet textile printing apparatus 1B according to Example 2 has a similar configuration to the ink jet textile printing apparatus 1A according to the above-described Example 1, in which the types of set trays 3 which can be detected are increased by one type and only the detection method and determining method of the set tray 3 which become necessary along with the increase of the types of set tray 3 are different to Example 1.

Accordingly, here, the type of detectable set tray 3 which is different to Example 1 and the ink jet textile printing method performed by using the ink jet textile printing apparatus 1B according to Example 2 will be described focusing on the stage of detecting and determining the type of set tray 3.

That is, the ink jet textile printing apparatus 1B is configured to be able to perform a carriage first movement step moving the carriage 21 on which the detector 5 is mounted to a first position Q1 in the scanning direction which is a detection position; a set tray first movement step moving the set tray 3 in which the target textile printing material T is set to a first position P1 in the moving direction which is a detection position; a set tray second movement step moving the set tray 3 moved to the first position P1 in the moving direction to a second position P2 in the moving direction which is a detection position; a carriage second movement step moving the carriage 21 moved to the first position Q1 in the scanning direction to a second position Q2 in the scanning direction which is a detection position; a type specifying step specifying the type of the set tray 3 based on detection information detected in each movement step; and a determining step comparing the type of the set tray 3 specified in the type specifying step and the type of set tray 3' recognized in advance and determining whether both are matched or mismatched.

Accordingly, the point that a carriage second movement step has been added in the respective steps performed by the ink jet textile printing apparatus 1A described in the above Example 1 is the main point of difference to Example 1.

Figure 5:
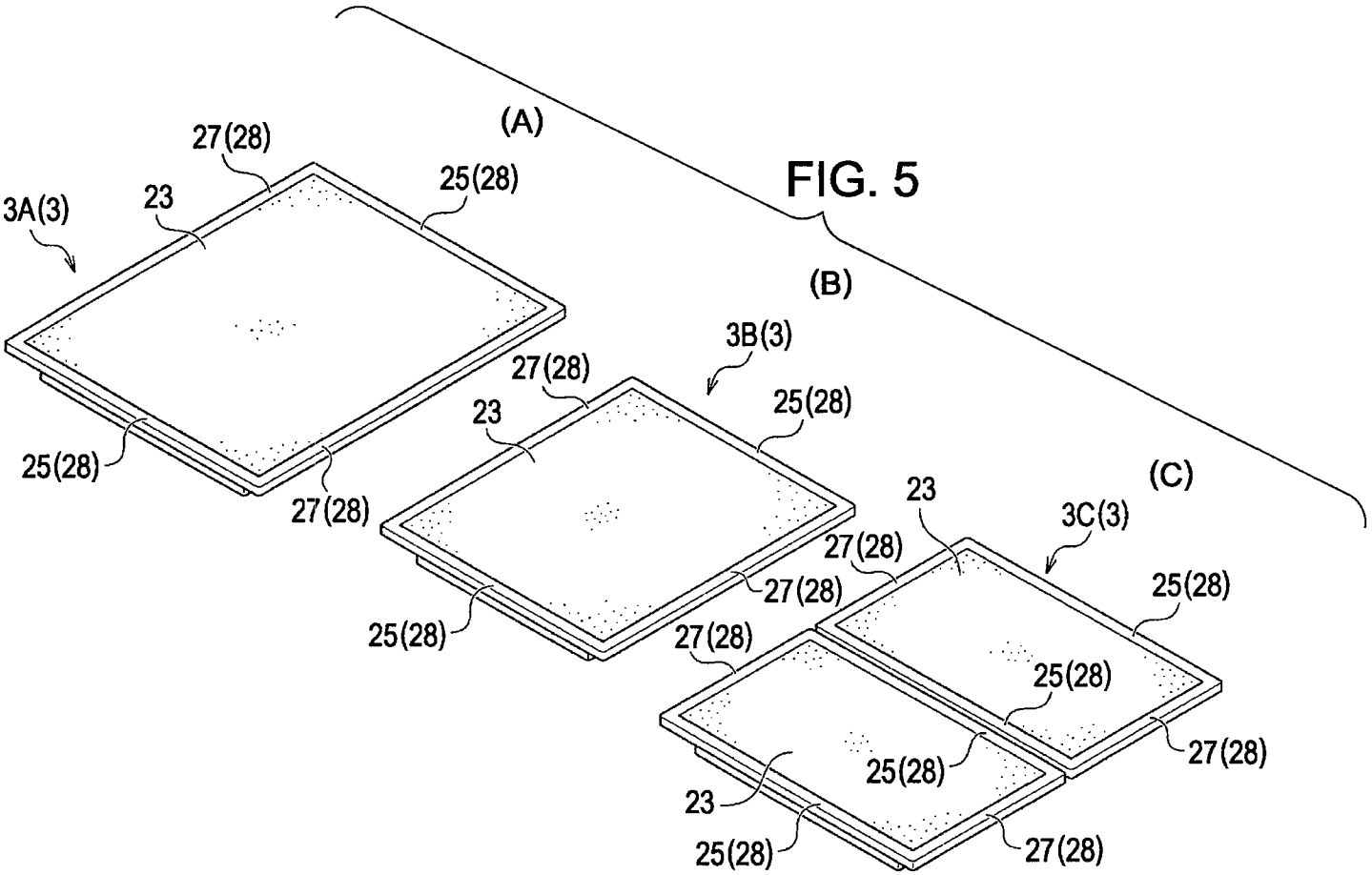
FIG. 5 is a perspective view showing types of set trays used in the ink jet textile printing apparatus according to Example 1 of the present invention.

Further, as the types of set tray 3, as shown in FIG. 9(D), there is a configuration in which a narrow width set tray 3D of approximately half the width dimension of the large size set tray 3A shown in FIG. 9(A) is added to the large size set tray 3A shown in FIG. 9(A), the small size set tray 3B shown in FIG. 9(B), and the differently shaped set tray 3C shown in FIG. 9(C) with the same configuration as (A) to (C) in FIG. 5 described in Example 1.

Figure 10:
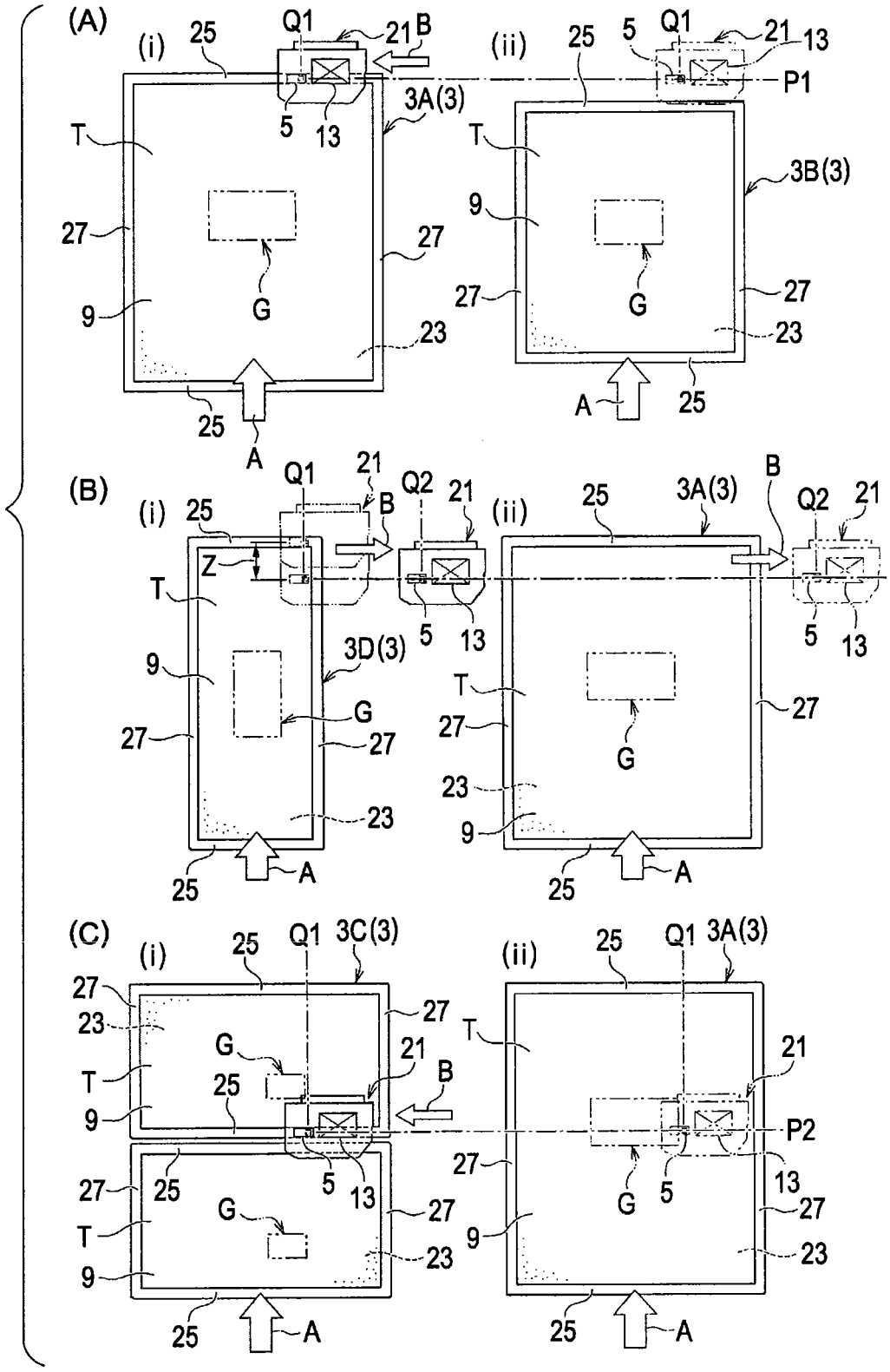
FIG. 10 is a plan view showing an example of the order of detecting the types of set tray using the ink jet textile printing apparatus according to Example 2 of the present invention.

Below, based on FIG. 10 and FIG. 11, description will be given of an example of the detection process of the type of the set tray 3 and an example of the flow of operations at the time of detection.

After setting the target textile printing material T on the setting surface 23 of the set tray 3 positioned at the set position S, stretching the wrinkles, and fitting the frame 28 to the set tray 3, the user sets (set information 35) the type or the like of the set tray 3 to be used and issues a command to perform textile printing.

Figure 11:
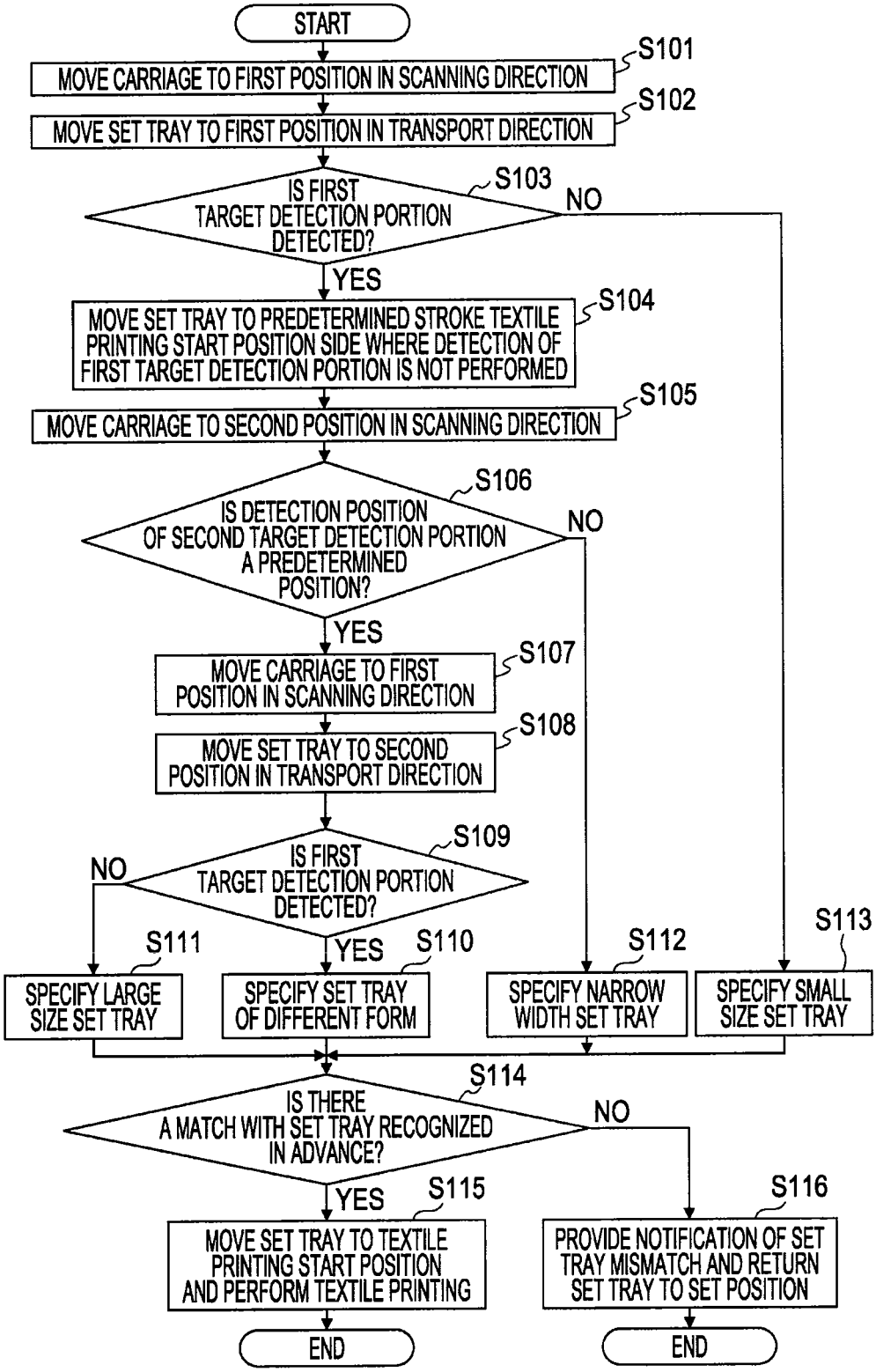
FIG. 11 is a flowchart showing an example of a flow of operations detecting the type of set tray using the ink jet textile printing apparatus according to Example 2 of the present invention.

Next, the command to perform the textile printing is received and the detection and determining operation of the set tray 3 is started with the flow shown in FIG. 11, and, in step S101 in FIG. 11, the carriage 21 is made to move to the first position Q1 in the scanning direction.

Next, moving to step S102, the moving unit 17 is driven and the set tray 3 is made to move to the first position P1 in the moving direction. Here, at the first position P1 in the moving direction, at a time when a large size set tray 3A is used, a time when a differently shaped set tray 3C is used, and a time when a narrow width set tray 3D is used, first target detection portions 25 of these set trays 3A, 3C, and 3D are set to be positioned below the detector 5 as shown in FIG. 10(A)(i).

Meanwhile, when using a small size set tray 3B, as shown in FIG. 10(A)(ii), the first target detection portion 25 of the set tray 3B below the detector 5 is in a state of not yet being reached.

Next, returning to FIG. 11 and moving to step S103, the detector 5 positioned at the first position Q1 in the scanning direction performs determination of whether or not the first target detection portion 25 is detected. Then, in a case where detection of the first target detection portion 25 is confirmed, the process moves to step S104, the moving unit 17 is driven, and the set tray 3 is made to move (FIG. 10(B)) up to the textile printing start position K side by a predetermined stroke Z at which the detection of the first target detection portion 25 is no longer performed.

Next, moving to step S105, the carriage 21 is driven and made to move to the second position Q2 in the scanning direction. Here, in the present Example, since the second position Q2 of the scanning direction is set to an outer region of the home position side where the detector 5 does not detect the second target detection portion 27 when the large size set tray 3A is used, the configuration is set to be able to detect the second target detection portion 27 of the set tray 3 without fail during the movement to the second position Q2 in the scanning direction.

Accordingly, in a case where the width dimension of the set tray 3 as shown in FIG. 10(B)(i) is narrow, the second target detection portion 27 is detected at an early timing, and in a case where the width dimension of the set tray 3 as shown in FIG. 10(B)(ii) is wide, the second target detection portion 27 is detected at a late timing.

Next, returning to FIG. 11, in step S106, determination of whether or not the detection position of the second target detection portion 27 is a predetermined position is performed. Here, in the present Example 2, the detection position of the second target detection portion 27 at the time of using a large size set tray 3A is set to a predetermined position.

Then, in step S106, in a case where it is determined that the detection position of the second target detection portion 27 is a predetermined position, the process moves to step S107, the carriage 21 is driven and moved again to the first position Q1 in the scanning direction.

Next, moving to step S108, the moving unit 17 is driven and the set tray 3 is made to move to the second position P2 in the moving direction.

Here, at the second position P2 in the moving direction, at a time when a differently shaped set tray 3C is used, the first target detection portion 25 of the set tray 3C and an interval between the front and rear set trays 3C are confirmed by the detector 5 as shown in FIG. 10(C)(i). Meanwhile, when using a large size set tray 3A, these are not confirmed since the first target detection portion 25 and the interval as shown in FIG. 10(C)(ii) are not present.

Next, returning to FIG. 11, it is determined whether or not the first target detection portion 25 was detected in step S109. In a case where the first target detection portion 25 was detected, the process moves to step S110 and the differently shaped set tray 3C is specified.

Further, in a case where it is determined that the first target detection portion 25 was not detected in step S109, the process moves to step S111 and the large size set tray 3A is specified.

Further, in a case where it is determined that the detection position of the second target detection portion 27 is not the predetermined position in step S106, the process moves to step S112 and the narrow width set tray 3D is specified.

Further, in a case where it is determined that the first target detection portion 25 was not detected in step S103, the process moves to step S113 and the small size set tray 3B is specified.

Next, moving to step S114, in a case where determination of whether or not there is a match with the set tray 3' recognized in advance is performed and it is determined that there is a match with the set tray 3' recognized in advance, the process moves to step S115, the moving unit 17 is driven, the set tray 3 is made to move up to the textile printing start position K, and textile printing is performed.

Meanwhile, in a case where it is determined that there is no match with the set tray 3' recognized in advance in step S114, the process moves to step S116, notification of the mismatch of the set tray 3 is provided, the moving unit 17 is driven in the reverse direction, and the set tray 3 is returned to the starting set position S.

When the ink jet textile printing apparatus 1B according to the present Example 2 is used in this manner, the same action and effect as the above-described Example 1 are exhibited, and, by further expanding the types of set tray 3 which can be detected, an ink jet textile printing apparatus 1B capable of detecting and determining an even greater number of set trays 3 having different sizes, shapes, and configurations can be applied.

Modification of Example 2

Figure 12:
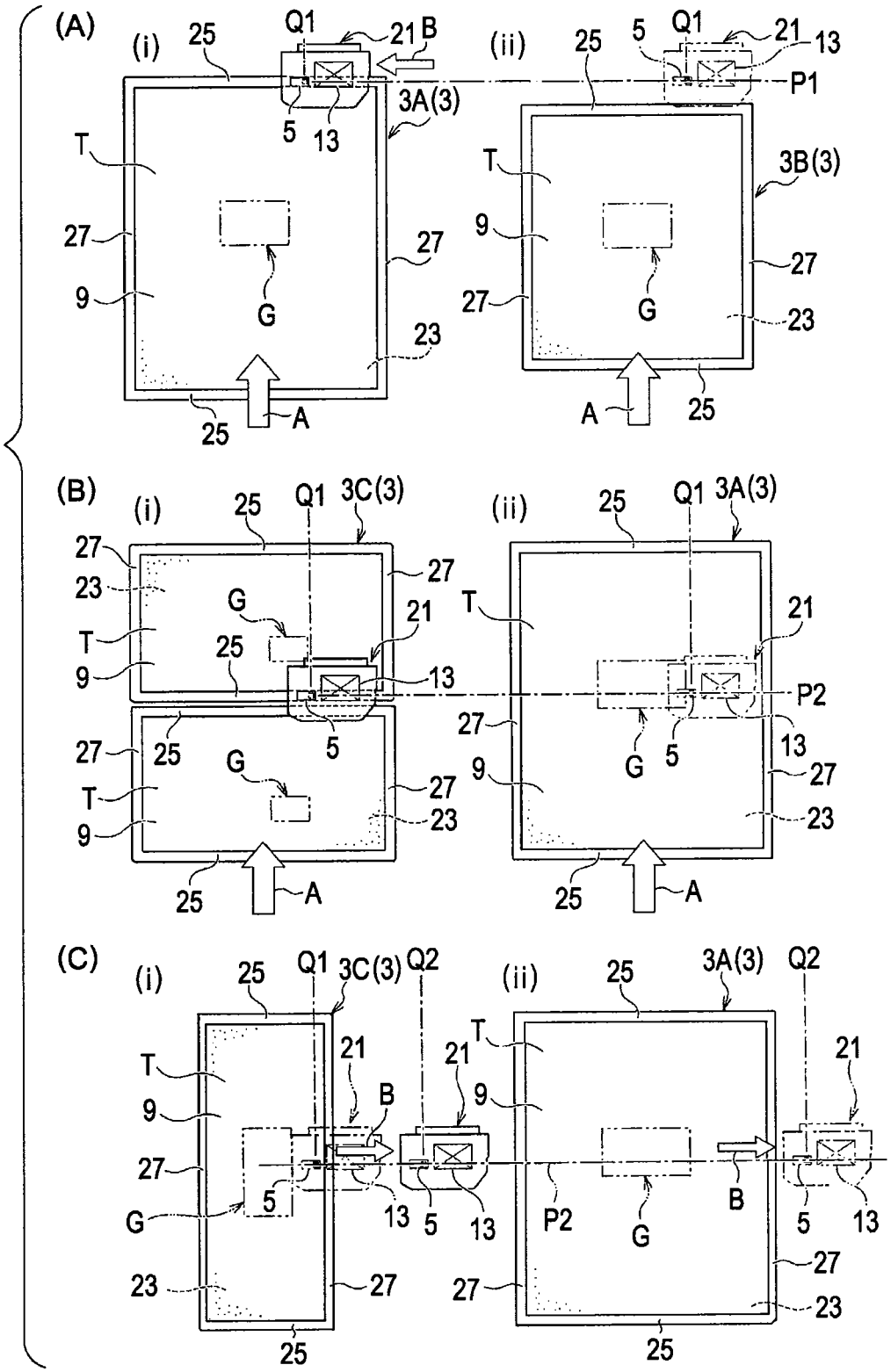
FIG. 12 is a plan view showing another example of the order of detecting the types of set tray using the ink jet textile printing apparatus according to Example 2 of the present invention.
Figure 13:
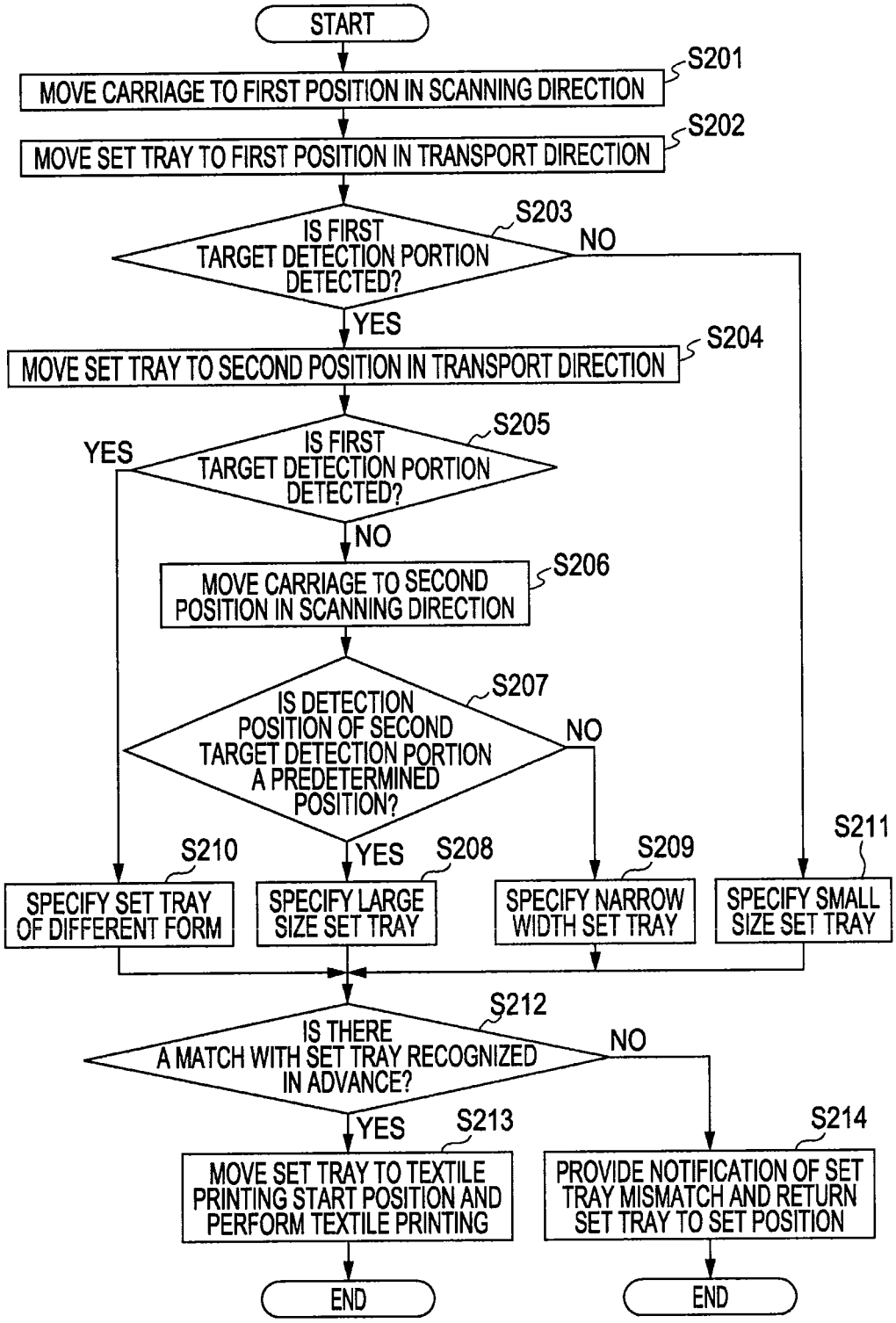
FIG. 13 is a flowchart showing another example of a flow of operations detecting the type of set tray using the ink jet textile printing apparatus according to Example 2 of the present invention.

In addition, in a case where the ink jet textile printing apparatus 1B according to the present Example is used, it is possible to make use of another example in which the detection process of the type of set tray 3 shown in FIG. 12 is made to be different and another example in which the flow of operations at the time of detection shown in FIG. 13 is made to be different.

In other words, in this case, when the command to perform textile printing is received from the user, the detection and determining operation of the set tray 3 is started with the flow shown in FIG. 13, and the carriage 21 is made to move to the first position Q1 in the scanning direction in step S201 in FIG. 13.

Next, moving to step S202, the moving unit 17 is driven and the set tray 3 is made to move to the first position P1 in the moving direction. Here, at the first position P1 in the moving direction, at a time when a large size set tray 3A is used, a time when a differently shaped set tray 3C is used, and a time when a narrow width set tray 3D is used, first target detection portions 25 of these set trays 3A, 3C, and 3D are set to be positioned below the detector 5 as shown in FIG. 12(A)(i).

Meanwhile, when using a small size set tray 3B, as shown in FIG. 12(A)(ii), the first target detection portion 25 of the set tray 3B below the detector 5 is in a state of not yet being reached.

Next, returning to FIG. 13 and moving to step S203, the detector 5 positioned at the first position Q1 in the scanning direction performs determination of whether or not the first target detection portion 25 is detected. Then, in a case where detection of the first target detection portion 25 is confirmed, the process moves to step S204, the moving unit 17 is driven, and the set tray 3 is made to move up to the second position P2 in the moving direction. Next, moving to step S205, the detector 5 performs determining whether or not the first target detection portion 25 is detected.

In a case where it is determined that the first target detection portion 25 was not detected in step S205, the process moves to step S206 and the carriage 21 is driven and made to move to the second position Q2 in the scanning direction.

Here, in the present Example 2, since the second position Q2 of the scanning direction is set to an outer region of the home position side where the detector 5 does not detect the second target detection portion 27 when the large size set tray 3A is used, the configuration is set to be able to detect the second target detection portion 27 of the set tray 3 without fail during the movement to the second position Q2 in the scanning direction.

Accordingly, in a case where the width dimension of the set tray 3 as shown in FIG. 12(C)(i) is narrow, the second target detection portion 27 is detected at an early timing, and in a case where the width dimension of the set tray 3 as shown in FIG. 12(C)(ii) is wide, the second target detection portion 27 is detected at a late timing.

Next, returning to FIG. 13, in step S207, determination of whether or not the detection position of the second target detection portion 27 is a predetermined position is performed. Here, in the present Example 2, the detection position of the second target detection portion 27 at the time of using a large size set tray 3A is set to a predetermined position.

Here, in a case where it is determined that the detection position of the second target detection portion 27 is the predetermined position in step S207, the process moves to step S208 and the large size set tray 3A is specified.

Further, in a case where it is determined that the detection position of the second target detection portion 27 is not the predetermined position in step S207, the process moves to step S209 and the narrow width set tray 3D is specified.

Further, in a case where it is determined that the first target detection portion 25 was detected in step S205, the process moves to step S210 and the differently shaped set tray 3C is specified.

Further, in a case where it is determined that the first target detection portion 25 was not detected in step S203, the process moves to step S211 and the small size set tray 3B is specified.

Next, moving to step S212, in a case where determination of whether or not there is a match with the set tray 3' recognized in advance is performed and it is determined that there is a match with the set tray 3' recognized in advance, the process moves to step S213, the moving unit 17 is driven, the set tray 3 is made to move up to the textile printing start position K, and textile printing is performed.

Meanwhile, in a case where it is determined that there is no match with the set tray 3' recognized in advance in step S212, the process moves to step S214, notification of the mismatch of the set tray 3 is provided, the moving unit 17 is driven in the reverse direction, and the set tray 3 is returned to the starting set position S.

In addition, according to the detection and determination of the set tray 3 shown in FIG. 12 and FIG. 13, since the same action and effects as the detection and determination of the set tray 3 described above shown in FIG. 10 and FIG. 11 are obtained, and furthermore, a compact flow of operations with step S104 and step S107 in FIG. 11 omitted is realized, the time taken for the detection and determination of the set tray 3 is shortened.

Other Examples

The ink jet textile printing apparatus 1 according to the present invention is based on the configuration described above; however, changes, omissions, or the like of parts of the configuration within a range not departing from the gist of the present invention are possible.

For example, as well as being applied to a so-called serial-type textile printing head 13 mounted on a carriage 21 capable of reciprocal movement in the scanning direction B, the detector 5 can be applied to a so-called line-type textile printing head 13 performing textile printing in one stroke in the textile printing range of the width direction of the target textile printing material T.

In addition, as well as being provided to be adjacent to the textile printing head 13, the detector 5 can be installed in a fixed state at an appropriate location of the apparatus main body 2 of the ink jet textile printing apparatus 1 so as to be separated from the printing head 13.

Here, in these cases, since the movement of the carriage 21 is unnecessary, it is possible to omit step S1 in FIG. 7.

In addition, it is also possible to separately provide a mechanism and power moving the detector 5 in either or both of the length direction and the width direction of the set tray 3, as well as to provide a configuration provided with a plurality of detectors 5 and performing position detection of the first target detection portion 25 and the second target detection portion 27 of the set tray 3 using the plurality of detectors 5.

Figure 9:
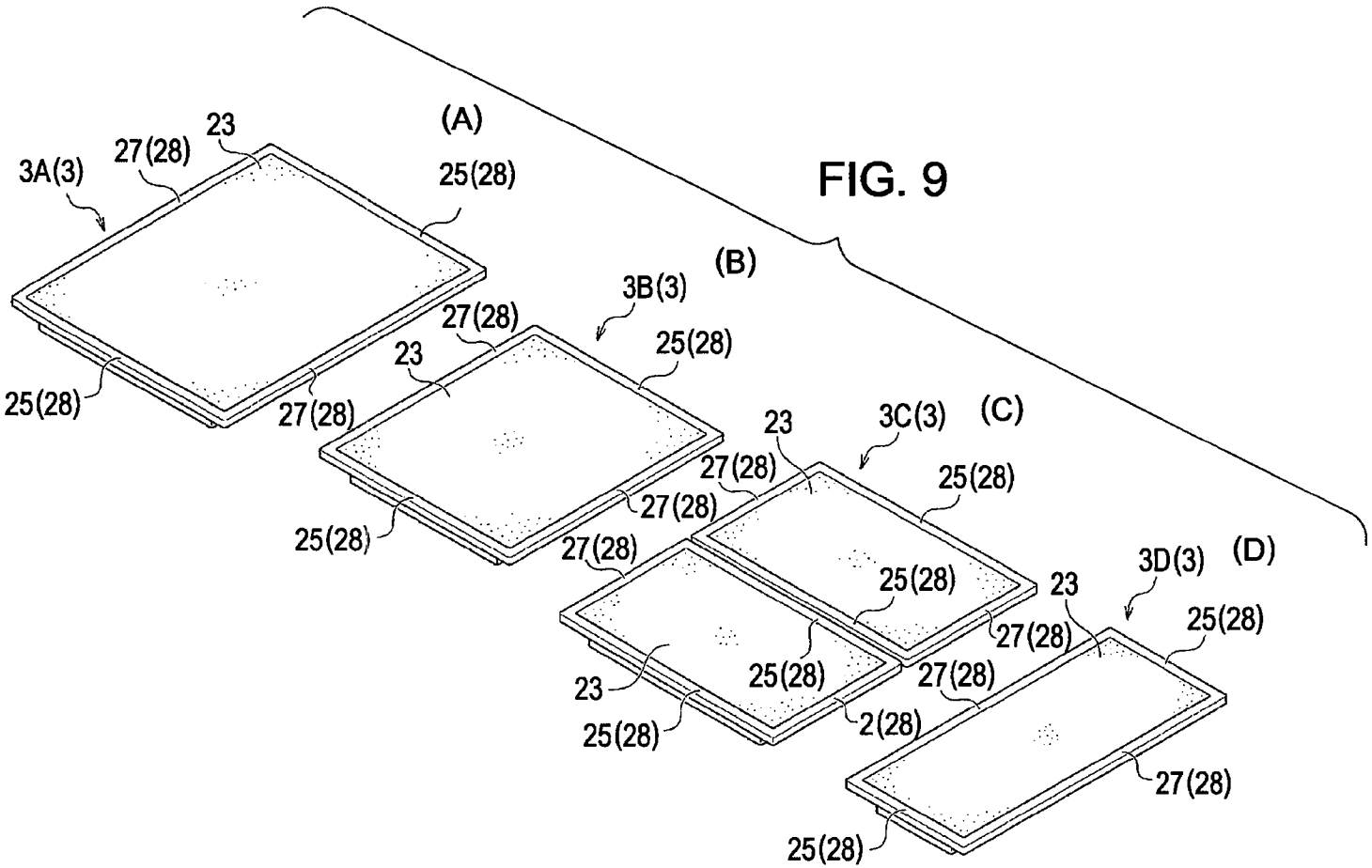
FIG. 9 is a perspective view showing types of set trays used in the ink jet textile printing apparatus according to Example 2 of the present invention.

In addition, the types of set tray 3 are not limited to those shown in the above-described FIG. 5 and FIG. 9, and it is possible to employ types of set tray 3 with various shapes, sizes, and configurations such as disc shaped ones, polygonal flat shaped ones other than rectangular ones, and ones in which two sets are disposed in the width direction.

In addition, in the control unit 19, as the form of the notification informing the user of the mismatch of the type of the set tray 3, various forms such as an alarm sound, speech, a lit or flashing LED, or a display on a display can be used alone, or a combination of several of these can be used.

REFERENCE SIGNS LIST

1: ink jet textile printing apparatus
2: apparatus main body
3: set tray
5: detector
7: determining unit
9: first surface
11: second surface
13: textile printing head
15: textile printing performing region
17: moving unit
19: control unit
21: carriage
23: setting surface
25: first target detection portion
27: second target detection portion
28: frame body
29: support base
31: support platform
32: tray mounting unit
33: type information
35: setting information
37: mismatch specifying information
41: ink cartridge
43: timing belt
T: target textile printing material (fabric)
G: printed image
A: moving direction
B: scanning direction
S: setting position
K: textile printing start position
P1: first position (of the moving direction)
P2: second position (of the moving direction)
Q1: first position (of the scanning direction)
Q2: second position (of the scanning direction)
Z: predetermined stroke

What is claimed is:

1. An ink jet textile printing apparatus comprising:

a tray mounting unit that is possible to replace a plurality of types of trays;

a detector that is capable of detecting a type of the tray mounted on the tray mounting unit; and a control unit that moves the tray mounted on the tray mounting unit to a first position, and that determines whether or not the detector detected a first target detection portion of the tray positioned at the first position.

2. The ink jet textile printing apparatus according to claim 1, wherein the plurality of types of trays includes a large size tray and a small size tray that is smaller than the large size tray, and the control unit determines the tray mounted on the tray mounting unit is the small size tray, when the detector did not detect the first target detection portion of the tray positioned at the first position.

3. The ink jet textile printing apparatus according to claim 1, wherein when the detector detected the first target detection portion of the tray positioned at the first position, the controller moves the tray mounted on the tray mounting unit to a second position, and determines whether or not the detector detected the first target detection portion of the tray positioned at the second position.

4. The ink jet textile printing apparatus according to claim 3, wherein the plurality of types of trays includes a large size tray and a small size tray that is smaller than the large size tray, and the control unit determines the tray mounted on the tray mounting unit is the large size tray, when the detector did not detect the first target detection portion of the tray positioned at the second position.

5. The ink jet textile printing apparatus according to claim 3, wherein the plurality of types of trays includes a large size tray and a different form tray whose form differs from the large size tray, and the control unit determines the tray mounted on the tray mounting unit is the different form tray, when the detector detected the first target detection portion of the tray positioned at the second position.

6. The ink jet textile printing apparatus according to claim 1, wherein the detector detects a second target detection portion of the tray mounted on the tray mounting unit by moving.

7. The ink jet textile printing apparatus according to claim 6, the plurality of types of trays includes a large size tray and a narrow width tray whose width is narrower than the large size tray, and the control unit determines the tray mounted on the tray mounting unit is the narrow width tray, when a detection position where the second target detection portion is detected by the detector is not a predetermined position.

* * * * *